United States Patent [19]

Thatcher et al.

[11] Patent Number: 4,475,562

[45] Date of Patent: Oct. 9, 1984

[54] METHOD AND APPARATUS FOR SEPARATING TOBACCO MIXTURE INTO LIGHTER AND HEAVIER FRACTIONS

[75] Inventors: Richard E. Thatcher, Chester; Horace L. Odom, Bon Air; Ronald L. Edwards, Richmond, all of Va.

[73] Assignee: Philip Morris Incorporated, New York, N.Y.

[21] Appl. No.: 312,014

[22] Filed: Oct. 16, 1981

[51] Int. Cl.[3] ..... A24C 1/02

[52] U.S. Cl. ..... 131/110; 209/136; 209/138

[58] Field of Search ..... 131/109 B, 110, 108, 131/84 B; 406/62; 209/133, 134, 136, 138, 139 R, 137

[56] References Cited

U.S. PATENT DOCUMENTS

| | | | |
|---|---|---|---|
| 2,267,326 | 12/1941 | Eissmann | 131/109 B |
| 2,941,667 | 6/1960 | Hilgartner | 209/134 |
| 3,265,209 | 8/1966 | Wochnowski et al. | 209/136 |
| 3,362,414 | 1/1968 | Wochnowski | 131/110 |
| 3,443,688 | 5/1969 | Molins | 131/110 |
| 3,450,139 | 6/1969 | Pietrucci | 131/110 |
| 3,593,851 | 7/1971 | Davidson | 209/133 |
| 3,608,716 | 9/1971 | Rowell | 209/139 R |
| 3,624,748 | 11/1971 | Strydom | 131/110 |
| 3,655,043 | 4/1972 | Wochnowski | 209/138 |
| 3,665,932 | 5/1972 | Goldbach | 131/110 |
| 3,727,755 | 4/1973 | Cristiani | 131/110 |
| 3,871,385 | 3/1975 | David | 131/110 |
| 3,986,949 | 10/1976 | DiDuca | 209/35 |
| 4,003,385 | 1/1977 | Adebahr et al. | 131/109 B |
| 4,083,499 | 4/1978 | Thatcher | 209/136 |

*Primary Examiner*—V. Millin
*Assistant Examiner*—Harry J. Macey
*Attorney, Agent, or Firm*—Laurence S. Rogers

[57] ABSTRACT

A tobacco leaf mixture containing lighter and heavier fractions is fed into one side of a housing while an air-stream flow is introduced at the other side of the housing and in an upwardly directed flow course so as to cause it to entrain the lighter fraction of the mixture therein, with the heavier fraction falling to the bottom of the housing. A suction lift is maintained at the top of the housing to increase the velocity of the lighter fraction containing air flow outwardly from the housing. The lighter fraction containing air flow is then delivered to a separator unit to recover the lighter fraction. The lighter fraction can, for example, be the laminae material from which shredded cigarette tobacco filler is made.

13 Claims, 3 Drawing Figures

METHOD AND APPARATUS FOR SEPARATING TOBACCO MIXTURE INTO LIGHTER AND HEAVIER FRACTIONS

BACKGROUND OF THE INVENTION

In the manufacture of cigarettes, the shredded cigarette filler is provided by shredding the laminae portion of tobacco leaves. As an adjunct and preliminary to shredding the laminae, it is necessary to separate the laminae from the stems and large veins or mid-ribs of the tobacco leaves. This generally is done by subjecting the cured tobacco leaf to a threshing operation which breaks up the tobacco leaves rendering them into a lighter laminae fraction and a heavier stem and/or vein or mid-rib fraction. It is then necessary to separate the threshed tobacco leaves into these two respective fractions so that the laminae readily can be incorporated into the cigarette manufacturing process. Heretofore the separation of the heavier fraction from the lighter fraction has involved utilization of a complicated processing operation including screening, etc. In addition to the fact that such prior known operations do not always successfully completely separate the stems and mid-ribs parts from the laminae, the processing operations require expenditure of a significant amount of energy. It is accordingly desirable that a method and apparatus be provided which effectively separates the tobacco leaf laminae from the remaining components of the tobacco leaf and at the same time does so with a minimum of handling of the tobacco mixture and requiring considerably lesser amounts of energy than heretofore required.

SUMMARY OF THE PRESENT INVENTION

The present invention is concerned with a method and apparatus for separating a lighter fraction-heavier fraction tobacco mixture into the respective fractions thereof. It will be understood that the lighter fraction of the mixture is comprised of the leaf laminae which is intended to be shredded as cigarette tobacco filler whereas, the heavier fraction comprises the leaf stem and large veins or mid-ribs.

In accordance with the invention, a zone of confinement is established in which separation is effected, with the zone having at least two opposed generally vertically directed zone defining margins. The zone further is provided such as to have a lower zone segment and upper zone segment in communication with the lower. The lower zone segment is formed to laterally widen from the bottom to the top thereof at least one of the two opposed margins being inclined at an angle to the vertical, while the upper zone segment laterally narrows from the bottom to the top thereof. The tobacco mixture to be separated into the respective fractions is introduced into the zone in the region of the juncture of the lower and upper zone segments and from one of the two opposed side margins thereof. At the same time, an airstream flow is fed into the lower zone segment at the bottom thereof and from the other of the two opposed margins with the airstream flow being in an upwardly directed flow course. The airstream velocity is sufficient within the zone of confinement to entrain the lighter fraction of the tobacco mixture therein and to carry it upwardly to the top of the upper zone segment, where it further increases the velocity of the lighter fraction containing air flow and pulls the air flow and contained lighter tobacco fraction outwardly from the zone. The lighter fraction containing air flow is then conveyed to a further separation operation such as a tangential separator unit wherein the lighter fraction is separated from the air flow. The airstream velocity is insufficient to lift the heavier tobacco fraction so it falls to the bottom of the lower zone segment where it is collected. The airstream is preferably caused to traverse the falling tobacco, to entrain any lights that may have been carried down by the heavies.

The apparatus for effecting the separation of tobacco mixture desirably comprises a housing having a lower housing part and upper housing part and is defined by a pair of opposed generally upright housing walls with one of the pair of walls in the lower housing part inclining outwardly away from the other to enlarge the lower housing part area while the pair of housing walls in the upper housing part converge towards each other to construct the area of the upper housing part. For introducing the tobacco into the housing, the same can be propelled into the housing with a mechanical impulse unit such as a rotary feeder device, or such means can be provided as an air current issuing from a rotary fan unit with an injection duct connecting the fan unit to the housing, the tobacco mixture being introduced into the suction entry of the fan unit. The fan unit can be provided as a torus ripper type fan unit which, in addition to feeding the tobacco mixture into the housing, functions to rip and break up the tobacco mixture before it is actually delivered into the housing. The housing is also provided in its lower housing part and at the side opposite from which the tobacco mixture is introduced into the housing, with a fan unit and duct means connecting the fan unit discharge to the housing so that a lifting airstream flow can be directed into the housing. The lifting airstream flowing into the housing rises upwardly against the inclined opposite wall of the housing from its point of entry and entrains the lighter fraction of the tobacco mixture carrying such lighter fraction upwardly and outwardly from the housing but such airstream flow being, by reason of its velocity and flow rate, insufficient to lift or carry upwardly the heavier fraction material present in the housing, such heavier fraction therefore falling to the bottom of the housing from which it can be collected.

The lighter tobacco fraction leaving the top of the housing is conveyed to a tangential separator unit in which the tobacco is separated from the airstream.

Since the tobacco introduced into the housing includes a heavier fraction which may also have lighter fraction material intermingled therewith, it is desirable that the heavier fraction prior to reaching the bottom of the housing be subjected to such handling as will enable the intermingled lighter fraction to be removed therefrom. For this purpose a device in the form of a downwardly and inwardly sloping sawtooth-like member is provided at the side of the housing opposite from which the tobacco mixture is introduced into the housing. By requiring that the heavier fraction which may contain intermingled therewith lighter fraction material to flow down this sawtooth device to a position where the falling tobacco is traversed again by the rising airstream, there is further opportunity for the upwardly flowing airstream to capture and entrain additional lighter fraction material and thus ensure its ultimate removal from the housing.

The invention accordingly comprises the features of construction, combination of elements, arrangement of parts and process steps which will be exemplified in the construction and method hereinafter set forth and the scope of the invention will be indicated in the claims.

BRIEF DESCRIPTION OF THE DRAWINGS

A fuller understanding of the nature and objects of the present invention will be had from the following detailed description taken in conjunction with the accompanying drawings in which.

Throughout the following description, like numerals are used to denote like parts in the drawings.

DESCRIPTION OF THE PREFERRED EMBODIMENTS

The present invention is concerned with a method for separating a lighter fraction material from a heavier fraction material of which a tobacco mixture is comprised. As used herein, it will be understood that "lighter fraction" illustratively refers to the laminae resulting from a threshing operation in which tobacco leaves are broken up into the laminae and stem and vein or mid-rib parts thereof. The heavier fraction includes the stems and large veins or mid-ribs.

Figure 1:
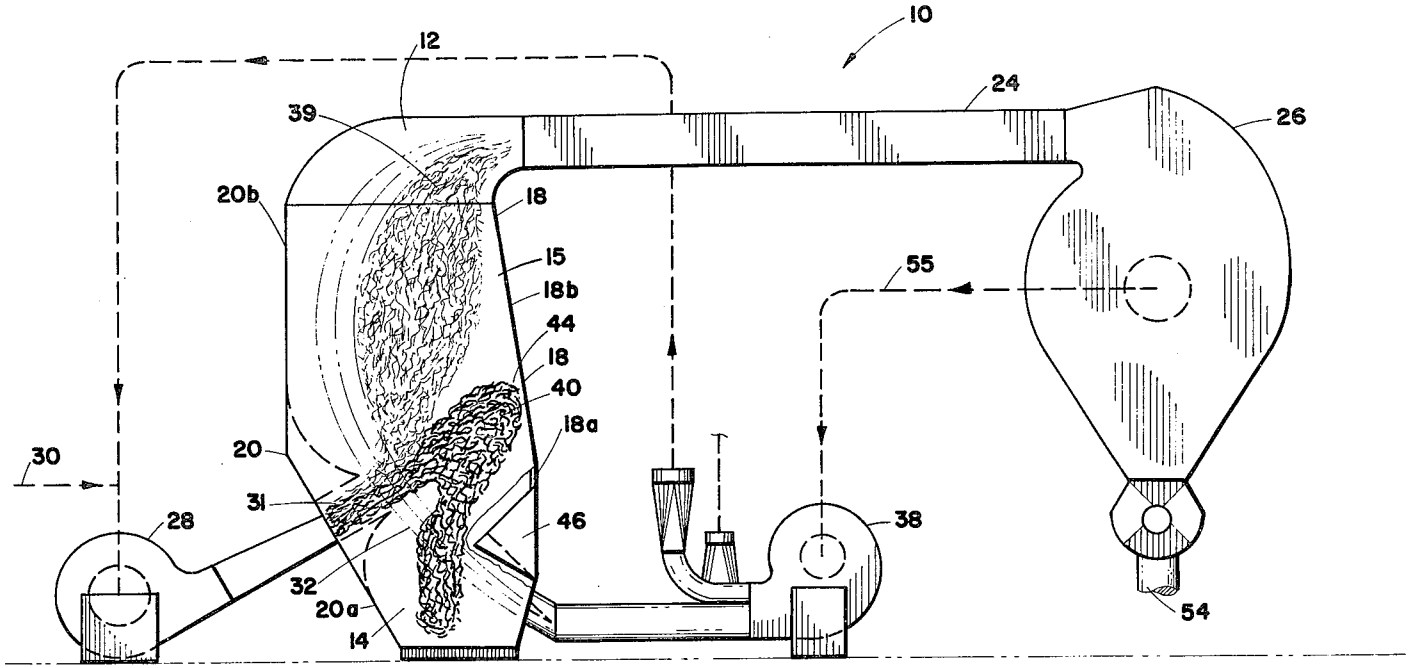
FIG. 1 is a side elevational view of one form of apparatus with which a tobacco mixture can be separated into respective lighter and heavier fractions thereof, the apparatus being particularly exemplified by the utilization of an air current feeding of the tobacco mixture into the apparatus for separation.
Figure 2:
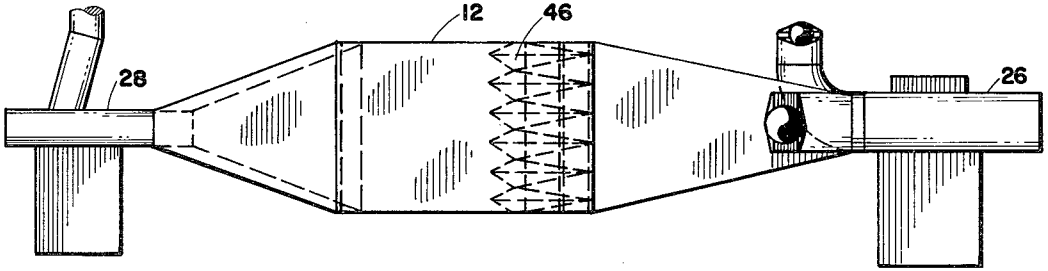
FIG. 2 is a top plan view of an apparatus shown in FIG. 1.

Referring now to FIG. 1 of the drawings, the apparatus 10 includes a housing 12 having lower housing part 14 and an upper housing part 15 in communication with the lower part. The housing includes at least two opposed generally vertically arranged side walls 18, 20, the side walls **18*a*, 20*a* associated with the lower housing part diverging. In other words, the side wall 18*a* in the lower part of the housing is disposed in a generally vertically perpendicular (i.e.) substantially vertically orientation, whereas, the opposed side wall part 20*a* diverges outwardly therefrom so as to increase the effective cross-sectional area of the lower housing part up to the location where the lower housing part is in juncture with the upper housing part. The side walls 18*b* and 20*b*** of the upper housing part, however, converge in the manner shown to effectively constrict the flow course of the lighter tobacco fraction containing airstream flow to be described shortly.

The top of the upper part 15 of the housing is maintained under a condition of suction lift produced by the connection thereof with duct 24 to the intake or suction side of a tangential separator unit 26. An air current flow enters the housing in the region where the lower part 14 thereof is in juncture with the upper part 15, such air current flow being provided by a torus ripper fan unit 28 into which is introduced the tobacco mixture by means of infeed line 30, the torus fan unit 28 tends to further break up the tobacco mixture which has been delivered from a threshing operation and delivers such mixture by means of the air current into the housing. Within the housing 12, the tobacco mixture 31 is directed into the path of an upwardly flowing airstream 32 shown in long and short dashed lines and delivered into the housing at the opposite side from the point at which the tobacco mixture is introduced by means of a fan unit 38. The airstream flow provided from fan unit 38 is thus upwardly directed and its velocity and flow rate is such as to entrain or carry upwardly the lighter fraction 39 of the tobacco mixture. The airstream flow, on the other hand, is not by reason of either its velocity or quantity of flow sufficient to carry any of the heavier fraction material 40 upwardly so the same falls downwardly within the housing to the bottom of the lower housing part where it can be collected. To facilitate liberation of any lighter fraction intermingled with the heavier fraction, the manner and direction of introduction of the tobacco mixture to the housing is such as to allow that it will impinge against the housing wall opposite from its point of introduction as at 44 and the heavier fraction will flow down at said opposite side and onto a sawtooth device 46 provided in the form of an inwardly and downwardly inclined having a plurality of tooth-like formations at the lower part thereof slideway. This further lengthens the time in which the heavier fraction is contained within the influence of the airstream flow so that the airstream can entrain any additional intermingled lighter fraction material.

The lighter fraction 39 entrained in the airstream flow is conveyed from the top of the housing to the intake side of the tangential separator unit 26 and in which the airstream is separated from the lighter fraction with the lighter fraction flowing out the bottom of the tangential separator as at 54 and the air axially from the tangential separator to the suction side of the fan unit 38 by means of return duct 55.

Figure 3:
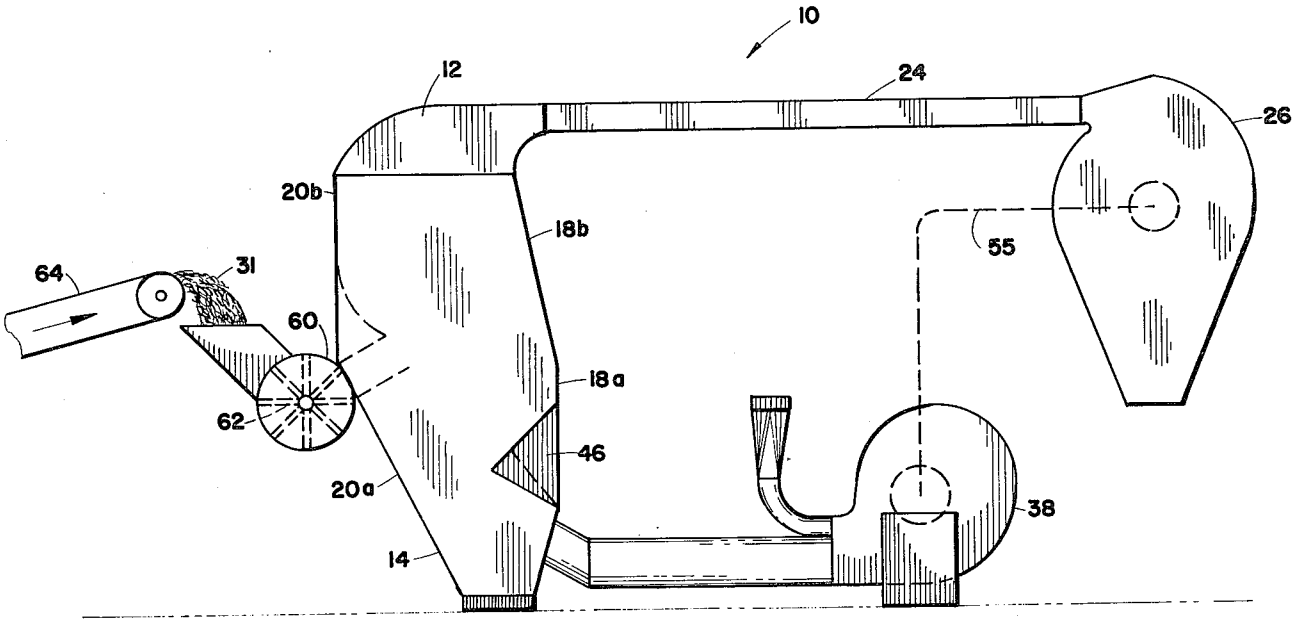
FIG. 3 is a side elevational view of a different embodiment of apparatus in which the tobacco mixture is introduced into the housing by use of a mechanical rotary infeed unit.

FIG. 3 depicts an alternative embodiment of the invention in which the means of introducing the tobacco mixture into the housing is provided in forms of a mechanical rotary impulse type unit 60 which by reason of the rotation of its rotor unit 62 impels or adds mechanical impulse momentum to the tobacco falling from conveyor unit 64 and thus delivering it into the interior of the housing.

While there is disclosed above only certain embodiments of the present invention, it is possible to introduce still other embodiments without departing from the scope of the inventive concept herein disclosed.

We claim:

1. A method for separating a tobacco mixture comprising a heavier and a lighter fraction into the respective fractions thereof, comprising the steps of:

establishing a zone of confinement including at least two opposed generally vertical zone defining margins;

introducing the tobacco mixture into said zone from one of said two margins thereof;

feeding an airstream flow upward into said zone at the bottom thereof from the other of said two opposed margins and through and traversing all of said tobacco mixture at an airstream velocity and flow rate sufficient to entrain said lighter fraction of said tobacco mixture but insufficient to retain said heavier fraction, allowing said heavier fraction to fall toward the bottom of said zone carrying a portion of said lighter fraction downward;

causing said airstream flow to pass through said falling tobacco a second time to separate from said heavier fraction any of said lighter fraction carried downward by said heavier fraction;

maintaining a suction lift in the upper portion of said zone to increase the velocity of said airstream flow therethrough and out of said zone;

conveying said airstream flow from said zone to a separation device and separating said lighter fraction from said airstream flow; and collecting said heavier fraction at the bottom of said zone.

2. The method of claim 1 in which the tobacco mixture is fed into said zone by mechanical impulse force imparted to said mixture.

3. The method of claim 1 in which the tobacco mixture is fed into said zone by an air current.

4. Apparatus for separating a tobacco mixture comprising a lighter and a heavier fraction into the respective fractions thereof, said apparatus comprising:

a housing, including a pair of opposed generally upright walls;

means for introducing the tobacco mixture through one said wall into said housing;

means for feeding an airstream flow through the other said wall and upward into said housing at the bottom thereof, through the region into which the tobacco mixture is introduced, at a velocity and flow rate sufficient to entrain the lighter fraction of the tobacco mixture but insufficient to retain the heavier fraction, allowing the heavier fraction to fall toward the bottom of said housing carrying some of the lighter fraction with it;

means disposed in said housing for causing the falling heavier fraction to be traversed by the same airstream flow a second time for separating from the heavier fraction any of the lighter fraction carried down by the heavier fraction;

means for maintaining a suction lift in the upper portion of said housing to increase the velocity of the airstream flow therethrough;

a separator unit;

means for conveying the airstream flow from said housing to said separator unit; and means for collecting the heavier fraction in said housing.

5. The apparatus of claim 4 in which said means for introducing the tobacco mixture into said housing comprises a rotary propeller unit operable to mechanically propel a continuous feed of the mixture through said one wall.

6. The apparatus of claim 4 in which said means for introducing the tobacco mixture into said housing comprises: a rotary fan unit having a suction entry for receiving the tobacco mixture, and having a discharge; and an injection duct connecting said rotary fan unit discharge to said one wall.

7. The apparatus of claim 1 in which said means for feeding an airstream flow into said housing comprises a fan unit having a discharge and duct means connecting said discharge of said fan unit to said other wall.

8. The apparatus of claim 7 in which said duct means has a terminus section including an upwardly directed duct transition piece.

9. The apparatus of claim 7 in which said fan unit has a suction entry and said separator unit has an air outlet, and in which said suction entry is connected to said air outlet of said separator unit.

10. The apparatus of claim 4 in which said one wall is arranged substantially vertically and said other wall is inclined away from said wall at an angle of approximately 60° to the horizontal.

11. Apparatus for separating a tobacco mixture comprising a lighter and a heavier fraction into the respective fractions thereof, said apparatus comprising:

a housing, including a pair of opposed generally upright walls;

means for introducing the tobacco mixture through one said wall into said housing;

means for feeding an airstream flow through the other said wall and upward into said housing at the bottom thereof, through the region into which the tobacco mixture is introduced, at a velocity and flow rate sufficient to entrain the lighter fraction of the tobacco mixture but insufficient to retain the heavier fraction, allowing the heavier fraction to fall toward the bottom of said housing carrying some of the lighter fraction with it;

means disposed in said housing for causing the falling heavier fraction to be traversed by the airstream flow a second time for separating from the heavier fraction any of the lighter fraction carried down by the heavier fraction;

means for maintaining a suction lift in the upper portion of said housing to increase the velocity of the airstream flow therethrough;

a separator unit;

means for conveying the airstream flow from said housing to said separator unit; and means for collecting the heavier fraction in said housing;

said means for introducing the tobacco mixture into said housing comprising a torus ripper fan unit having a suction entry for receiving the tobacco mixture, and having a discharge and an injection duct connecting said rotary fan unit discharge to said one wall.

12. Apparatus for separating a tobacco mixture comprising a lighter and a heavier fraction into the respective fractions thereof, said apparatus comprising:

a housing, including a pair of opposed generally upright walls;

means for introducing the tobacco mixture through one said wall into said housing;

means for feeding an airstream flow through the other said wall and upward into said housing at the bottom thereof, through the region into which the tobacco mixture is introduced, at a velocity and flow rate sufficient to entrain the lighter fraction of the tobacco mixture but insufficient to retain the heavier fraction, allowing the heavier fraction to fall toward the bottom of said housing carrying some of the lighter fraction with it;

directing means disposed in said housing for causing the falling heavier fraction to be traversed by the airstream flow a second time for separating from the heavier fraction any of the lighter fraction carried down by the heavier fraction;

means for maintaining a suction lift in the upper portion of said housing to increase the velocity of the airstream flow therethrough;

a separator unit;

means for conveying the airstream flow from said housing to said separator unit; and means for collecting the heavier fraction in said housing;

said means for introducing the tobacco mixture into said housing comprising a rotary fan unit having a suction entry for receiving the tobacco mixture, and having a discharge and an injection duct connecting said rotary fan said directing means comprising sawtooth means disposed in said housing and on said other wall for receiving downward flow of the heavier tobacco fraction and directing that flow toward the bottom of said housing.

13. The apparatus of claim 12 in which said sawtooth means comprises a downwardly inclined inwardly sloping member having a plurality of tooth-like formations at the lower part thereof.

* * * * *